US005767481A

United States Patent [19]

Graf

[11] Patent Number: 5,767,481

[45] Date of Patent: Jun. 16, 1998

[54] LASER TAIL CUTTER ASSEMBLY

[75] Inventor: Edwin X. Graf, Menasha, Wis.

[73] Assignee: Voith Sulzer Paper Technology North America, Inc., Appleton, Wis.

[21] Appl. No.: 531,551

[22] Filed: Sep. 18, 1995

[51] Int. Cl.[6] ..... B23K 26/14

[52] U.S. Cl. ..... 219/121.67; 162/286; 219/121.84

[58] Field of Search ..... 219/121.67, 121.84, 219/121.72; 162/20, 50, 286, 902, 103; 34/90

[56] References Cited

U.S. PATENT DOCUMENTS

| | | | |
|---|---|---|---|
| 3,582,466 | 6/1971 | Quirk | 219/121.67 |
| 3,679,863 | 7/1972 | Houldcroft et al. | 219/121.72 |
| 3,761,675 | 9/1973 | Mason et al. | 219/121.67 |
| 4,039,799 | 8/1977 | Stumpf | 219/121.67 |
| 4,462,867 | 7/1984 | Fuller | 162/103 |
| 4,645,900 | 2/1987 | Heyden | 219/121.67 |
| 4,874,470 | 10/1989 | Skaugen | 162/286 |
| 4,918,836 | 4/1990 | Wedel | 162/286 |
| 4,952,771 | 8/1990 | Wrobel | 219/121.67 |
| 5,213,649 | 5/1993 | Sepavich et al. | 219/121.67 |
| 5,248,390 | 9/1993 | Fissmann et al. | 162/286 |

FOREIGN PATENT DOCUMENTS 4-151611 5/1992 Japan .

*Primary Examiner*—Geoffrey S. Evans
*Attorney, Agent, or Firm*—Taylor & Associates, P.C.

[57] ABSTRACT

A machine or making a fiber web such as paper with the fiber web having a running direction in the machine, the machine including a dryer section which removes moisture from the fiber web and a laser cutter assembly disposed adjacent the fiber web that generates a laser beam for cutting the fiber web. The laser cutter assembly includes a conduit that the laser beam passes through. The conduit includes a fluid inlet for receiving a fluid extinguishant such as carbon dioxide gas. A heat sink is used to prevent the laser through the conduit when the fluid extinguishant is absent in the conduit. The fluid extinguishant emitting from an outlet of the conduit inhibits generation of a flame caused by the cutting of the fiber web by the laser beam.

17 Claims, 2 Drawing Sheets

LASER TAIL CUTTER ASSEMBLY

BACKGROUND OF THE INVENTION

1. Field of the Invention

The present invention relates to paper-making machinery, and, more particularly, relates to a tail cutter for such machinery.

2. Description of the Related Art

In machinery for making or processing a fiber web, such as a paper web, it is sometimes necessary to cut the fiber web in a direction relative to the running direction thereof. For example, it is known to cut an edge strip or edge tail on the sides of the fiber web (with respect to the running direction thereof) for the purposes of truing up the same. Moreover, it is also known to cut the fiber web in a direction transverse to the running direction thereof. Typically, when the fiber web is cut in a direction transverse to the running direction thereof, a cutter assembly moves across the width of the machine while the fiber web continues to move in the running direction.

One type of known cutter assembly includes a knife blade disposed on a track assembly. The knife blade directly contacts and thereby cuts the fiber web as the knife blade is moved across the width of the machine using the track assembly. A problem with such a cutter assembly is that the knife blade becomes worn and dull over time. A dull knife blade may result in the fiber web being partially torn, rather than being cleanly cut, thereby resulting in the formation of paper lint and a slightly rough cut edge.

Another type of known cutter assembly includes a water jet which is directed under high pressure into contact with the paper web, to thereby cut the paper web. As with the knife blade cutter assembly, the water jet cutter assembly also moves across the width of the machine on a track assembly as the fiber web moves in the running direction thereof. A water jet cutter assembly also produces paper lint during the cutting process, and may result in the fiber web having a frayed edge where the cut is made. These loose fibers at the frayed edged will continue to shed even during subsequent printing operations which is not desirable. Further, because the fiber web is being cut with a water jet, a suitable device must be provided for capturing and properly disposing of or recirculating the water used thereby.

What is needed in the art is a cutter assembly which may be used to cut a fiber web which is not susceptible to mechanical wear at the cutting point, which does not require additional structure for the capture, disposal and/or recirculation of fluids, and which results in a relatively smooth cut edge which is free of lint.

SUMMARY OF THE INVENTION

The present invention provides a laser cutter assembly which can be used in a paper-making machine or off-line paper processing machine, and which is either disposed stationary or movable relative to the running direction of the paper web.

The invention comprises, in one form thereof, a machine for making a fiber web, with the fiber web having a running direction in the machine. The machine includes a dryer section which removes moisture from the fiber web. A laser cutter assembly associated with the dryer section is disposed adjacent to the fiber web. The laser cutter generates a laser beam for cutting the fiber web.

An advantage of the present invention is that a paper web is cleanly cut, without mechanically contacting the paper web.

Another advantage is that a lint free cut with a smooth edge is produced.

Yet another advantage is that the energy source used to cut the paper web need not be recirculated or reused.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
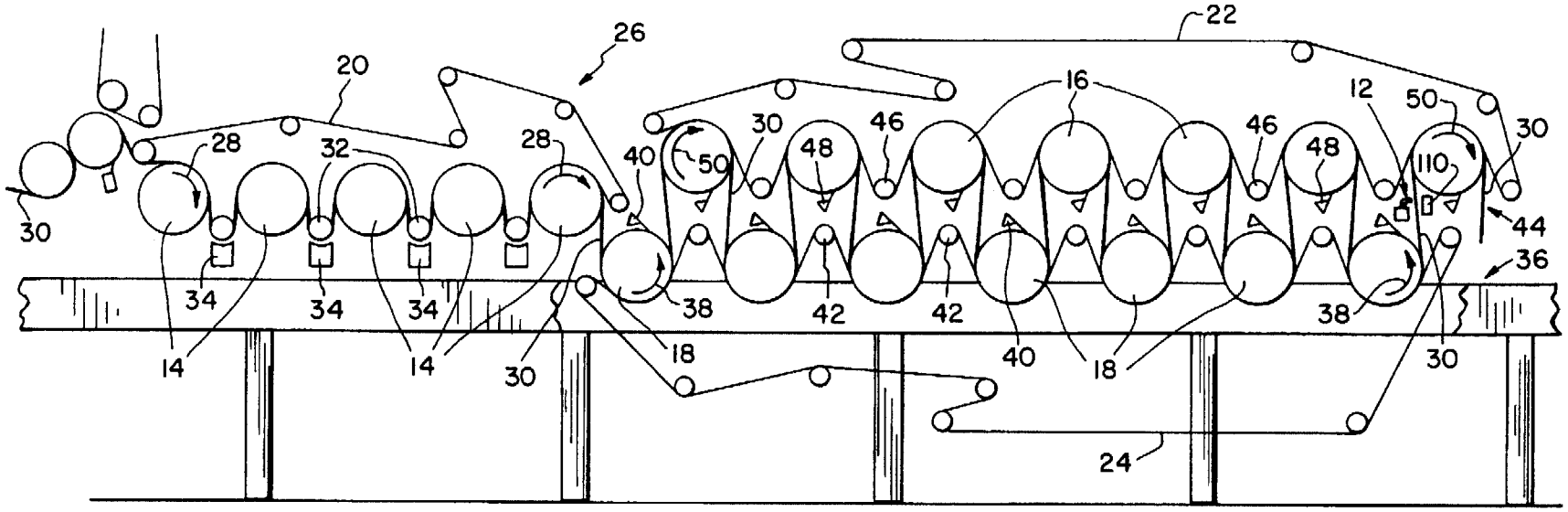
FIG. 1 is a schematical side view of an embodiment of a dryer section of a paper-making machine with which the laser cutter assembly of the present invention may be used.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

Referring now to the drawings and particularly to FIG. 1, there is shown an embodiment of a dryer section 10 of a papermaking machine with which the tail cutter assembly 12 of the present invention may be used. Dryer section 10 includes a plurality of dryer groups, with each dryer group being defined by a plurality of roles 14, 16 and 18 associated with corresponding endless belts 20, 22 and 24, respectively.

First dryer group 26 includes an endless belt or felt 20 disposed in association with each of rolls 14. Rolls 14 rotate, as indicated by directional arrows 28, and thereby define a running direction of a fiber web or paper web 30. Paper web 30 passes between felt 20 and each roll 14 as paper web 30 progresses in the running direction through first dryer group 26. Interposed between adjacent rolls 14 is a suction felt roll 32 which draws moisture from felt 20. An air box 34 is associated with each suction felt roll 32, and assists in the drying of paper web 30.

After passing through first dryer group 26, paper web 30 comes into contact with a dryer roll 18 of a second dryer group 36. Dryer rolls 18 of second dryer group 36 each rotate in the direction indicated by directional arrows 38. A plurality of scrapers 40 are respectively associated with each dryer roll 18, and remove excess material therefrom as roll 18 is rotated. Interposed between adjacent dryer rolls 18 is a smaller roll 42 which is positioned to maintain felt 24 in contact with a substantial portion of the periphery of each dryer roll 18.

With respect to the running direction of dryer section 10, it is apparent from FIG. 1 that fiber web 30 alternately engages dryer rolls 16, 18 of third dryer group 44 and second dryer group 36. Similar to second dryer group 36, as described above, third dryer group 44 also includes smaller rolls 46 disposed between adjacent dryer rolls 16, and scrapers 48 disposed in association with respective dryer rolls 16. Dryer rolls 16 rotate in the direction indicated by directional arrows 50. Thus, it will be appreciated that the configuration and operation of third dryer group 44 is similar to that of second dryer group 36, described above.

Figure 2:
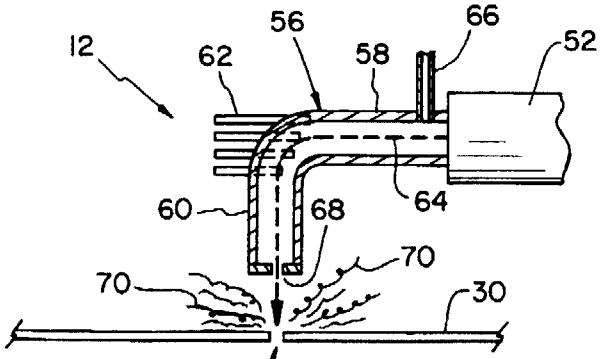
FIG. 2 is a fragmentary, side, sectional view of an embodiment of a laser cutter assembly of the present invention which may be used with the dryer section shown in FIG. 1.

Referring now to FIG. 2, an embodiment of a portion of laser cutter assembly 12 shown in FIG. 1 is illustrated in greater detail. Laser cutter assembly 12 is disposed in association with dryer section 10, as shown in FIG. 1, and adjacent to paper web 30. Laser cutter assembly 12 includes a generating device 52 for generating a laser beam for cutting fiber web 30. More particularly, generating device 52 is in the form of an industrial laser cutter, such as a carbon dioxide laser cutter, having a power level on the order of approximately 1,500 Watts. Laser beam generating device 52 generates a laser beam producing a slot 54 having a width between a range of approximately 0.010 to 0.025 inch (0.254 to 0.635 mm) in paper web 30.

Laser cutter assembly 12 also includes a conduit 56 having a first portion 58 which is connected to and disposed at an angle relative to a second portion 60. Conduit 56 includes a fluid inlet 66 for receiving a fluid extinguishant therein. Preferably, the fluid extinguishant is in the form of a flame retardant gas, such as carbon dioxide or Halon™. However, the fluid extinguishant may also be in the form of water within conduit 56 which is transformed to steam at an outlet 68 thereof. The flame extinguishant emitted from outlet 68, indicated generally by reference number 70, floods an area adjacent paper web 30 at slot 54 to inhibit generation of a flame caused by the cutting of paper web 30 with laser beam 64.

More particularly, the fluid extinguishant disposed within conduit 56 acts to direct laser beam 64 and direct laser beam 64 from first portion 58 to second portion 60. The combination of conduit 56 and the fluid flame extinguishant disposed therein thus acts similar in principle to a fiber optic cable which is also capable of bending a light beam.

A device or heat sink 62 disposed in conduit 56 at a juncture between first portion 58 and second portion 60 prevents a laser beam 64, generated by laser beam generating device 52, from passing through conduit 56 in an absence of a flame extinguishant therein. More particularly, in the absence of the fluid flame extinguishant within conduit 56, laser beam 64 is not bent or directed through outlet 68, but rather impinges upon heat sink 62, which dissipates the heat absorbed thereby. Heat sink 62 therefore absorbs the energy produced by laser beam generating device 52 and prevents cutting of paper web 30 with laser beam 64 when the fluid flame extinguishant is not present within conduit 56.

Referring again to FIG. 1, an energy absorbing target or heat sink 110 is shown in relationship to laser generating device 12. Heat sink 110 absorbs the energy of a laser beam produced by a laser beam generating device 12, after laser beam generating device 12 cuts paper web 30. Alternatively, heat sink 110 can be eliminated by focusing the laser beam produced by laser beam generating device 12 such that structure disposed on the opposite side of paper web 30 from laser beam generating device 12 is not affected thereby.

Figure 3:
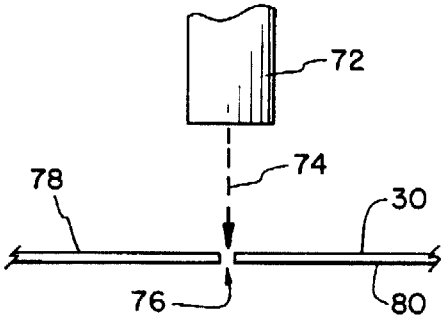
FIG. 3 is a fragmentary, side, sectional view of another embodiment of a laser cutter assembly of the present invention which may be used with the dryer section shown in FIG. 1.

Referring now to FIG. 3, another embodiment of a laser beam generating device 72 is shown. Similar to the embodiment shown in FIG. 2, laser beam generating device 72 generates a laser beam 74 which cuts a paper web 30. Laser beam generating device 72 produces a slot 76 in paper web 30 which preferably has a width between a range of 0.10 to 0.25 inch; however, other slot widths are also possible. Laser beam generating device 72 can be used to cut paper web 30 either in a direction parallel or transverse to the running direction of paper web 30. If, e.g., laser beam generating device 72 is used to cut paper web 30 in a direction parallel to the running direction thereof, then a first part 78 could be in the form of an edge strip or edge tail, and a second part 80 would be the trimmed, main part of paper web 30. Configured as such, laser beam generating device 72 is positioned stationary and paper web 30 is cut by laser beam 74 as it moves therepast. On the other hand, if laser beam generating device 72 cuts paper web 30 in a direction transverse to the running direction thereof (and assuming paper web 30 is moving from left to right in the embodiment shown in FIG. 3), then first part 78 could be a web leader and second part 80 could be a web end. Configured as such, laser beam generating device 72 forms a part of laser cutter assembly 12 shown in FIG. 1, and moves transverse to the running direction of paper web 30. An example of a laser beam generating device 72 which has been found to satisfactorily cut a paper web is model DC-015, manufactured by Rofen-Senae, Inc.

Figure 4:
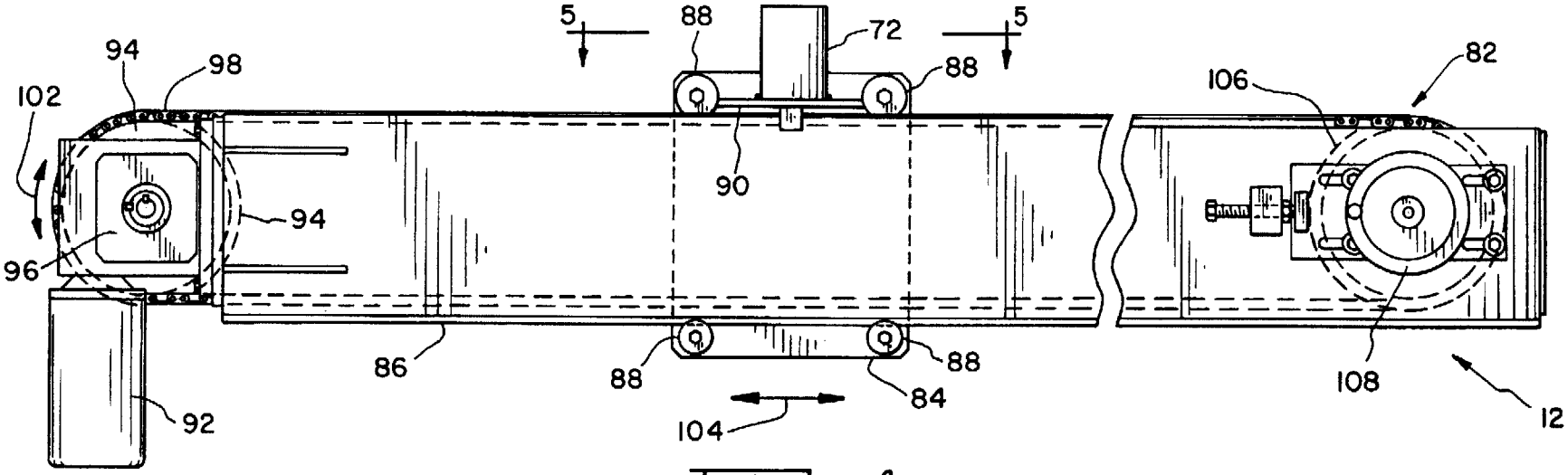
FIG. 4 is an elevational view of a track assembly to which the laser cutter assembly of the present invention can be attached, with the laser cutter assembly being represented schematically.
Figure 5:
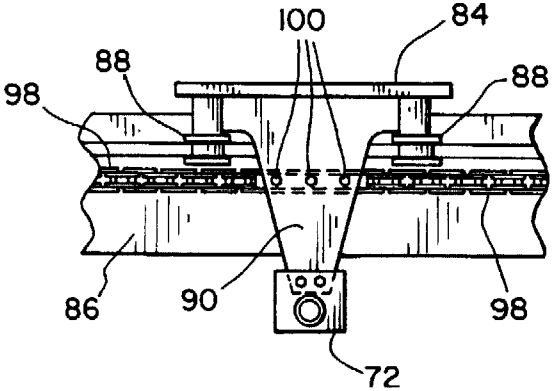
FIG. 5 is a fragmentary, top view of the track assembly shown in FIG. 4.

Referring now to FIG. 4, laser beam generating device 72 shown in FIG. 3 is illustrated in schematic form in conjunction with a track assembly 82. Laser beam generating device 72 and track assembly 82 define an embodiment of a laser cutter assembly 12 shown in FIG. 1. Track assembly 82 includes a carriage 84 which is slidably connected to a frame 86 using a plurality of rollers 88. Laser beam generating device 72, shown a simplified, schematic form in FIGS. 4 and 5, is attached to a plate 90 of carriage 84. As carriage 84 slides along frame 86, laser beam generating device 72 is operable to cut paper web 30.

Disposed at one end of frame 86 is a drive motor 92 which rotatably drives a sprocket 94 through an intermediate transmission 96. Sprocket 94 in turn drives a roller chain 98 which is affixed to carriage 84, as indicated by pins 100 (FIG. 5). Sprocket 94 is rotatable in either direction, as indicated by directional arrow 102, using motor 92, and thereby moves carriage 84 in a direction along the length of frame 86, as indicated by arrow 104.

Disposed at an opposite end of and rotatably connected to frame 86 is an idler sprocket 106 which engages roller chain 98. Handwheel 108 allows manual rotation of idler sprocket 106 when drive motor 92 is in an inoperative state, and thereby allows manual sliding movement of carriage 84 along frame 86.

In the embodiment shown, laser beam generating device 72 is an industrial-type laser cutter having a sufficient power level, etc. to cut paper web 30. However, it is also possible and within the scope of the present invention to direct a laser beam for cutting paper web 30 using a fiber optic bundle.

Further, in the embodiments shown in the drawings, laser beam generating device 72 moves across the width of paper web 30 by sliding along track assembly 82. However, it is also possible and within the scope of this invention to direct the laser beam used to cut paper web 30 using reflective mirrors which reflect the laser beam and are movably controlled using a control system.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A machine for one of making and processing a fiber web, the fiber web having a running direction in said machine, said machine comprising:

a laser cutter assembly disposed adjacent to the fiber web, said laser cutter assembly including means for generating a laser beam for cutting the fiber web, said generating means being one of stationary and movable relative to the running direction of the fiber web;

means for flooding an area with a flame extinguishant where the fiber web is cut by said laser beam; and means for preventing cutting of the fiber web with the laser beam in an absence of the flame extinguishant.

2. The machine of claim 1, further comprising a dryer section, said laser cutter assembly disposed in association with said dryer section.

3. The machine of 2, further comprising means for cutting the fiber web with said laser cutter assembly in a predetermined direction relative to the running direction of the fiber web.

4. The machine of claim 3, wherein said cutting means comprises a means for moving said laser cutter assembly in a direction which is generally perpendicular to the running direction of the fiber web.

5. The machine of claim 4, wherein said moving means comprises a track assembly extending in said generally perpendicular direction.

6. The machine of claim 3, wherein said cutting means comprises a stationary position of said laser cutter assembly along a side of said fiber web.

7. The machine of claim 2, wherein said dryer section comprises a plurality of dryer groups including a first dryer group, each said dryer group having a plurality of rolls associated with a corresponding endless belt, said laser cutter assembly disposed after said first dryer group with respect to said running direction of the fiber web.

8. The machine of claim 1, wherein said flooding means comprises a conduit through which each of the laser beam and the flame extinguishant pass.

9. The machine of claim 1, wherein said flame extinguishant comprises a gas.

10. The machine of claim 1, further comprising a conduit, said conduit structure and arranged such that the laser beam passes therethrough, said preventing means comprising a heat sink disposed in said conduit.

11. A machine for one of making and processing a fiber web, the fiber web having a running direction in said machine, said machine comprising:

a dryer section for removing moisture from the fiber web;

a laser cutter assembly associated with said dryer section and disposed adjacent to the fiber web, said laser cutter assembly including means for generating a laser beam for cutting the fiber web, said laser cutter assembly further including a conduit structured and arranged such that said laser beam passes therethrough, said conduit including a fluid inlet for receiving a fluid extinguishant therein; and means for preventing the laser beam from passing through said conduit when the fluid extinguishant is not present therein.

12. The machine of claim 11, wherein said conduit includes the fluid extinguishant therein, said fluid extinguishant consisting essentially of water.

13. The machine of claim 11, wherein said conduit includes a first portion and a second portion, said first portion disposed at an angle relative to said second portion, said preventing means comprising a heat sink disposed in said conduit at a juncture between said first portion and said second portion.

14. The machine of claim 11, wherein said laser cutter assembly comprises a carbon dioxide laser cutter.

15. The machine of claim 11, wherein said laser cutter assembly includes a means for generating a laser beam having a slot width between a range of 0.010 to 0.025 inch (0.254 to 0.635 mm).

16. The machine of claim 11, wherein said conduit includes the fluid extinguishant therein, said fluid extinguishant consisting essentially of a flame retardant gas.

17. The machine of claim 16, wherein said flame retardant gas consists essentially of carbon dioxide.

* * * * *

UNITED STATES PATENT AND TRADEMARK OFFICE

CERTIFICATE OF CORRECTION

PATENT NO. : 5,767,481

DATED : June 16, 1998

INVENTOR(S) : Edwin X. Graf

It is certified that error appears in the above-identified patent and that said Letters Patent is hereby corrected as shown below:

On the title page

Abstract, item [57]

line 1, delete "or", substitute --for-- therefor.

Signed and Sealed this

Fifth Day of January, 1999

*Attest:*

*Attesting Officer*

*Acting Commissioner of Patents and Trademarks*